US005648796A

United States Patent [19]

Boursier et al.

[11] Patent Number: 5,648,796

[45] Date of Patent: Jul. 15, 1997

[54] METHOD AND DEVICE FOR GENERATING GREY LEVELS IN A PASSIVE MARTIX LIQUID CRYSTAL DISPLAY SCREEN

[75] Inventors: Alain Boursier, Le Mans; Rémy De Crouychanel, Rueil Malmaison; Louis Giron, Mulsanne, all of France

[73] Assignee: U.S. Philips Corporation, New York, N.Y.

[21] Appl. No.: 549,890

[22] Filed: Oct. 30, 1995

Related U.S. Application Data

[63] Continuation of Ser. No. 237,482, May 3, 1994, abandoned.

[30] Foreign Application Priority Data

May 5, 1993 [FR] France ..... 93 05366

[51] Int. Cl.[6] ..... G09G 5/10

[52] U.S. Cl. ..... 345/149; 345/147

[58] Field of Search ..... 345/147, 149, 345/89, 88; 358/455, 457, 458

[56] References Cited

U.S. PATENT DOCUMENTS 3,997,719 12/1976 Judice ..... 345/149

5,053,764 10/1991 Barbier et al. ..... 345/148

5,130,821 7/1992 Ng ..... 358/458

5,220,314 6/1993 Mano et al. ..... 345/88

FOREIGN PATENT DOCUMENTS 0387033 9/1990 European Pat. Off. ..... 345/149

*Primary Examiner*—Richard Hjerpe

*Assistant Examiner*—Kent Chang

*Attorney, Agent, or Firm*—John C. Fox; Norman N. Spain

[57] ABSTRACT

As a surface having an apparent grey level is obtained by activating a certain proportion of pixels of this surface, the screen is virtually divided into blocks of pixels all having the same dimensions and a set of patterns each representing a block is defined in advance for each desired apparent grey level, while the different patterns of one and the same set all have the same proportion of active pixels, for example two out of sixteen for a grey level of 2/16 in the scale ranging from white to black (20–27) but a different arrangement of inactive pixels and active pixels, and for the display of each pixel of the image a pattern of the set corresponding to the desired grey level is selected, and the pixel is displayed in the active or inactive state of the dot having the same position in the selected pattern. A different pattern (from 20 to 27) is chosen at each redefinition of an image.

9 Claims, 5 Drawing Sheets

METHOD AND DEVICE FOR GENERATING GREY LEVELS IN A PASSIVE MARTIX LIQUID CRYSTAL DISPLAY SCREEN

This is a continuation of application Ser. No. 08/237,482, filed May 3, 1994, now abandoned.

BACKGROUND OF THE INVENTION

The invention relates to a method of generating a visual appearance of different gray level in a liquid crystal display screen having a passive matrix of pixels incapable of generating dots which are really grey but have only an active or an inactive state for each pixel, a surface having an apparent grey level being obtained by activating a given proportion of pixels, and the screen being virtually divided into pixel blocks all having the same dimension, while patterns of dots are defined in advance, each pattern representing a block and corresponding to one of the grey levels due to the fact that it has a number of active dots corresponding to this grey level, a pixel contained in a block of the image being displayed with the active or the inactive state of the dot which, in a pattern corresponding to the grey level desired for said pixel, has the same position as the pixel in the block comprising this pixel.

The invention also relates to a device for generating the appearance of grey levels in a liquid crystal display screen having a passive matrix of pixels incapable of generating really grey dots, comprising a wired logic circuit which computes the state in which a pixel is to be displayed as a function of its position in a block and as a function of the grey level desired for this pixel.

The invention is used in devices for displaying stationary images, notably in videophones, "Minitel", or portable computers.

A method and a device for generating different grey levels in a liquid crystal display screen is known from the document DE 39 06 924. In the system described in this document the screen is divided into blocks each comprising a plurality of pixels and a desired grey level is obtained by activating a certain proportion of pixels of a block as a function of the desired grey level, and the choice of the position of the pixels which are activated is modified in the course of time by a cyclic shift of the position of the active pixels within a block. Since the shift of the active dots is relatively regular, it is to be feared that other troublesome visual effects appear which are different from those eliminated by means of the method described in this document. Moreover, the circuit proposed for carrying the method into effect is relatively complex and comprises a large number of logic elements.

OBJECTS AND SUMMARY OF THE INVENTION

It is an object of the invention to provide a method and a device which are simpler and more flexible and allow the use of a circuit comprising fewer logic elements.

To this end, a set comprising a limited number of basic patterns is defined in advance, each pattern of a set comprising a number of active pixels per pattern equal to a power of two, while the basic patterns have such a composition that each position of an active pixel is exclusively utilized in a single one of the basic patterns of the set, and a pattern for generating a grey level not provided in the set of patterns is constructed by superimposing several patterns of this set.

The superimposition of two (or more) basic patterns corresponding to two different grey levels provides the possibility of generating intermediate grey levels between two grey levels for which there is a basic pattern, and the number of basic patterns may thus be reduced, which simplifies the circuit used for performing the method.

For a periodical redefinition of the patterns, an assembly of several sets of different basic patterns is advantageously defined in advance, each of the sets complying with the rule that each position of an active pixel is exclusively utilized in a single one of the basic patterns of the same set, and the periodical redefinition of the patterns is realised by cyclically selecting all the sets of this assembly in turns.

It is thereby avoided that the eye can see the patterns of dots, thanks to the fact that a periodical redefinition provides different patterns one after the other so that the eye does not have the time to distinguish one from the other.

When a zone of the same grey level covers several blocks of neighbouring pixels in the image in a regular manner, there is a risk that, due to its repetitive geometrical character, the visual appearance of artifacts in the zone in question is generated.

To avoid this, when the same grey level is desired for two pixels, one of which is situated in a block and the other in a neighbouring block, a set of patterns is selected in different assemblies for each of these two pixels.

A device according to the invention is characterized in that, with "n" being an integral number, said wired logic circuit comprises a circuit for defining the state of the pixel which is provided with two sets of n coordinate input terminals each for receiving a bit of coordinates of a pixel and n "grey" input terminals each for receiving a grey bit and a "black" input for a bit possibly indicating whether the pixel is 100% black, and is constituted by n exclusive-OR gates each having two inputs, n AND gates each having at least two inputs and an OR output gate having n+1 inputs, and each of the two inputs of each exclusive-OR gate is connected to one of the coordinate input terminals and, by attributing a number to each of the OR gates and to each of the AND gates, the output of an exclusive-OR gate of a given number is connected to an input of the AND gate of the same number and of the AND gates of the higher number, if any, each of the outputs of the AND gates is connected to an input of the output OR gate whose output supplies the state to be given to the pixel, and each grey input is connected to an input of one of the AND gates and the black input is connected to an input of the output OR gate.

While retaining a relatively simple construction, such a circuit provides the possibility of computing the definition of a pixel on the basis of patterns all of which are different.

The wired combinatorial circuit advantageously comprises, in series in the path of certain coordinate bits, an adder circuit having two groups of n inputs and n outputs, one of the groups of n inputs being connected to n coordinate input terminals, while n conductors each conveying a bit indicating a numbering of the image are connected to the other group of n inputs, the n outputs of the adder being connected to one of the sets of coordinate inputs of the circuit for defining the state of the pixel.

The pattern between a definition of the image and the next definition can thereby be changed.

The combinatorial circuit also advantageously comprises, in series in the path of coordinate bits, a mixer circuit constituted by logic elements modifying the coordinate bits.

It has been found by experiment that the presence of such a mixer circuit considerably reduces the risk of a visual appearance of artifacts in an extended zone having the same grey level.

The number n being even, each mixer sub-circuit is advantageously constituted by two mixer sub-circuits each having n input terminals for the coordinates, and n outputs, and the bits of the smallest weight of each coordinate are applied to one of the sub-circuits and the bits of the largest weight are applied to the other sub-circuit.

The number n being equal to four, each mixer sub-circuit is constituted by logic elements representing the following Boolean equations, the four inputs being denoted X0, X1 for the coordinates plotted on the abscissa, Y0, Y1 for the coordinates plotted on the ordinate and the outputs being denoted P0–P3:

$$P0=X1\oplus Y0$$

$$P1=X0\oplus Y1$$

$$P2=X1\oplus Y0\oplus Y1$$

$$P3=X1\oplus X0$$

BRIEF DESCRIPTION OF THE DRAWINGS

These and other aspects of the invention will be apparent from and elucidated with reference to the embodiments described hereinafter.

In the drawings

DESCRIPTION OF THE PREFERRED EMBODIMENTS

Figure 1:
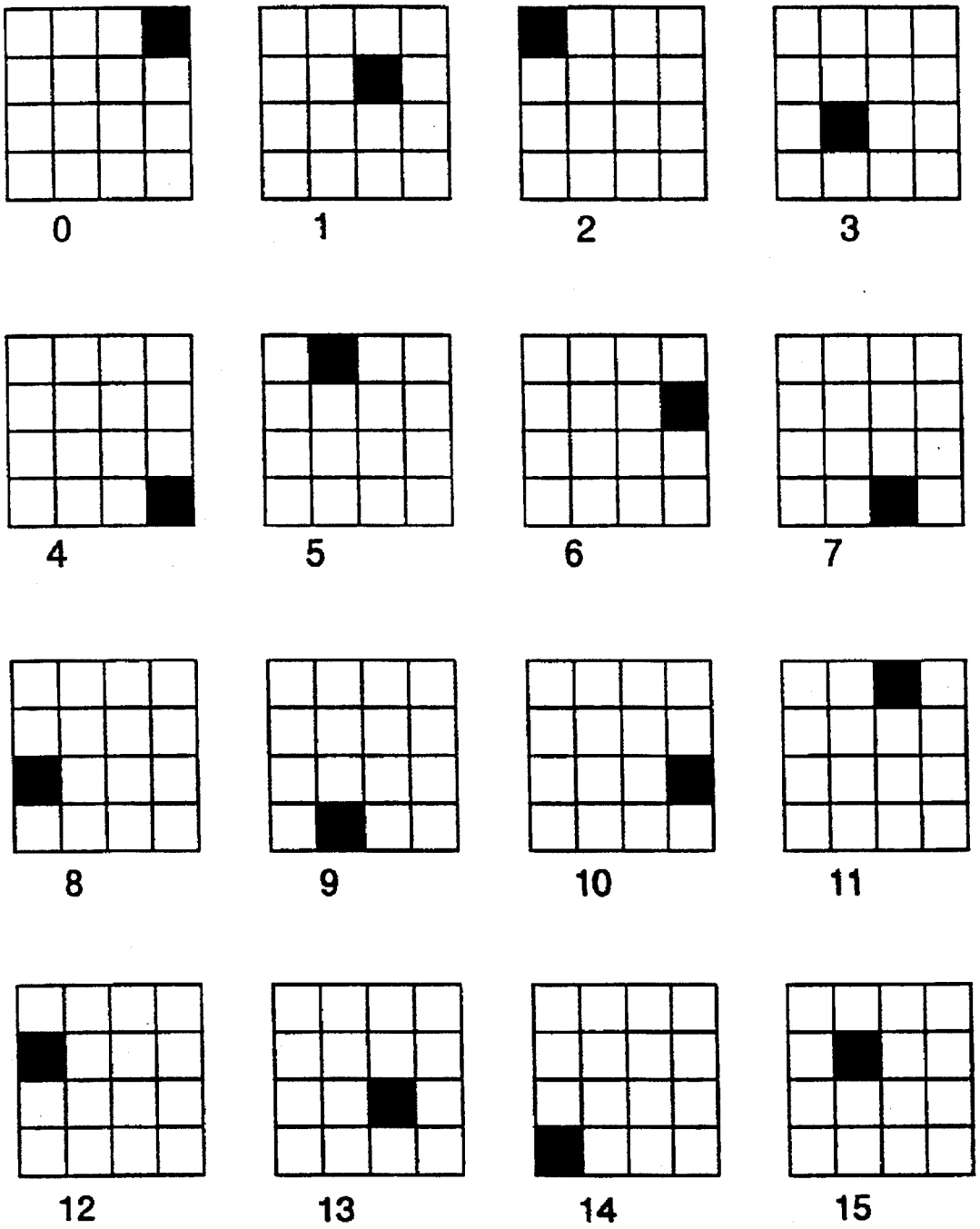
FIG. 1 shows an example of a set of sixteen patterns for a grey level of 1/16.

For displaying an image there is a permanent availability of data contained, for example in a memory with which the grey level of a pixel can be made to correspond to each coordinate of such a pixel. Due to the fact that in a passive matrix liquid crystal display screen each displayable pixel is active or inactive without any possible intermediate level when an image to be displayed comprises the indication of a grey level for each pixel, a surface with a visual grey appearance is obtained by activating a certain proportion of pixels of this surface. The state of each pixel of the screen is redefined periodically, while the electrical capacitance enables a liquid crystal cell to preserve the information between two redefinitions.

As the screen is virtually divided into blocks of pixels all having the same dimensions, the proportion of active pixels is treated at the level of a block. The process, if employed for square blocks, can yield palettes of five tints for a square of 2 ×2, ten tints for a square of 3×3, or seventeen tints for a square of 4×4, etc. It is to be noted that (n×n)+1 tints are obtained for a square having dimensions of n×n. For obtaining, for example seventeen tints on a scale ranging from white to black by activating a certain proportion of pixels in a block, a proportion of active pixels ranging from 0/16 to 16/16 should be obtained, i.e. a block should contain a number of pixels which is equal to a multiple of sixteen; in the present example a block will comprise 4×4 pixels.

A set of basic patterns of the same dimensions as a block is defined as being patterns each dot of which represents a pixel which is either active or inactive, each of these blocks comprising sixteen dots in the example chosen. A limited set may comprise, for example the patterns 0, 20, 30, 40 of FIGS. 1, 2, 3, 4, respectively. The patterns of such a predefined set correspond to a number of active pixels in a block equal to a power of two: a single active pixel in the pattern 0 of FIG. 1, two active pixels in the pattern 20 of FIG. 2, four active pixels in the pattern 30 of FIG. 3, and eight active pixels in the pattern 40 of FIG. 4. If the basic patterns 0, 20, 30, 40 in question are superimposed, a complex pattern is obtained in which fifteen pixels are active, while no active pixel of a basic pattern is superimposed on an active pixel of another basic pattern. Let it be assumed that the desired tint for a pixel is 11/16(11 =8+2+1). The patterns 40 of FIG. 4 (eight active dots), 20 of FIG. 2 (two active dots), 0 of FIG. 1 (one active dot) will then be superimposed so as to yield 11/16.

For each desired apparent grey level not only a set of dot patterns is defined in advance, but also an assembly of sets of dot patterns, in which a different set will be chosen at each redefinition.

FIG. 1 shows an example of a set of sixteen patterns for a grey level of 1/16. The pattern 0, for example has an active pixel at the top right, the pattern 1 has an active pixel at the coordinates X=2 and Y=1(X and Y being counted from 0 to 3 and from top to bottom for Y), etc. The different patterns of this set all have a single dot representing an active pixel, but no pattern has an active pixel which is situated at the same position as in another pattern. At each redefinition the set of selected patterns always comprises four patterns having one/two/four/eight active dots, respectively, and each time the set pattern which comprises an active pixel is selected from the patterns of the assembly of FIG. 1, each pattern 0 to 15 being thus selected in turns (after pattern 15, one starts at pattern 0 again).

Figure 2:
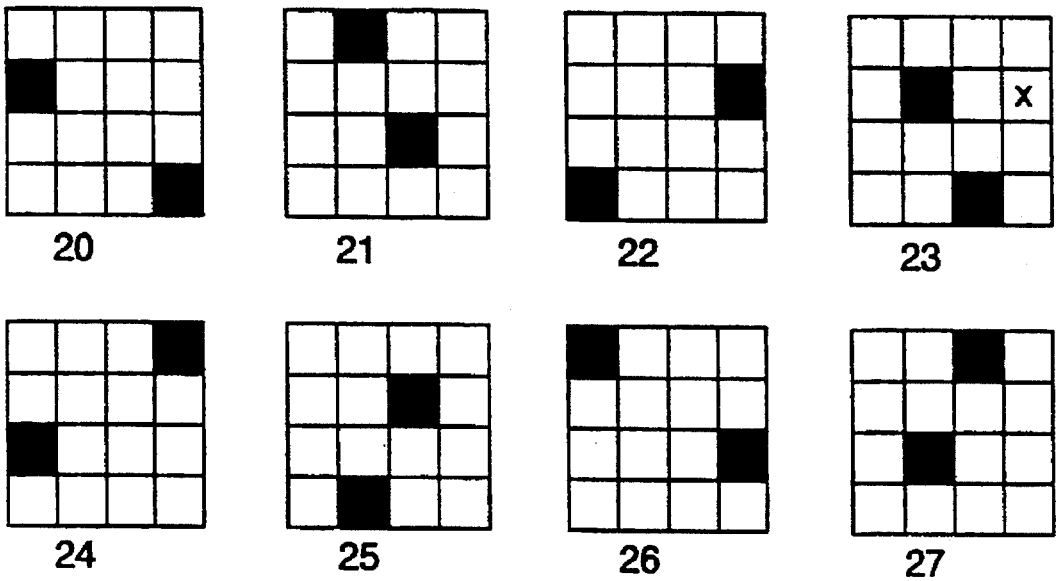
FIG. 2 shows an example of a set of eight patterns for a grey level of 1/8.

FIG. 2 shows an example of a set of eight patterns for a grey level of 1/8. For example, the pattern 20 has an active pixel at the coordinates X=0 and Y=1 and an active pixel at the coordinates X=3 and Y=3, the pattern 21 has an active pixel at the coordinates X=1 and Y=0 and an active pixel at the coordinates X=2 and Y=2, etc. The different patterns of this set all have two dots representing an active pixel, but no pattern has an active pixel which is situated at the same position as in another pattern. Of course, the set cannot comprise more than eight different patterns fulfilling this condition. At each redefinition the set pattern which comprises two active pixels is selected from the patterns of the assembly of FIG. 2, each pattern 20 to 27 being thus selected in turns (after pattern 27, one starts at pattern 20 again).

Figure 3:
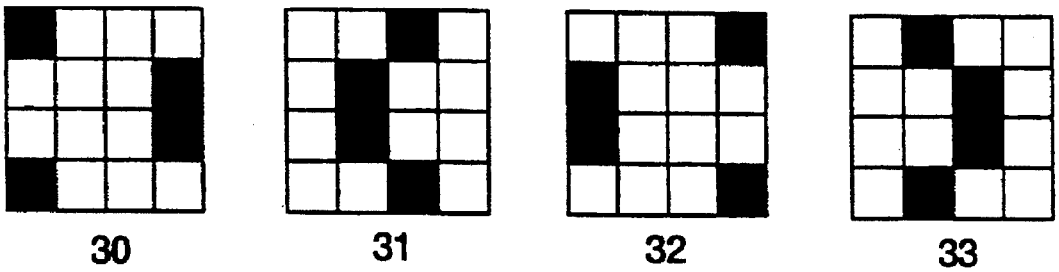
FIG. 3 shows an example of a set of four patterns for a grey level of 1/4.

FIG. 3 shows an example of a set of four patterns for a grey level of 1/4. For example, the pattern 30 has an active pixel at the coordinates X=0 and Y=0, at the coordinates X=3 and Y=1, at the coordinates X=3 and Y=2 and at the coordinates X=0 and Y=3. Also in this case the different patterns of this set all have four dots representing an active pixel, but no pattern has an active pixel which is situated at the same position as in another pattern. Of course, the set cannot comprise more than four different patterns. At each redefinition the set pattern which comprises four active pixels is selected from the patterns of the assembly of FIG. 3, each pattern 30 to 33 being thus selected in turns (after pattern 33, one starts at pattern 30 again).

Figure 4:
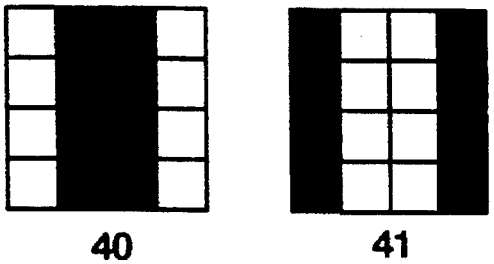
FIG. 4 shows an example of a set of two patterns for a grey level of 1/2.

FIG. 4 shows an example of a set of two patterns for a grey level of ½. The two patterns 40, 41 of this set all have eight dots representing an active pixel, but no pattern has an active pixel which is situated at the same position as in another pattern. Of course, the set cannot comprise more than two different patterns. At each redefinition the set pattern which comprises four active pixels is selected from the patterns of the assembly of FIG. 4, each pattern 40 and 41 being thus selected in turns.

As a pattern constituted by one or several superimposed basic patterns and corresponding to a given grey level is selected, a pixel occupying a particular position in one of the blocks of pixels is displayed with the active or inactive state of the dot having the same position in the selected pattern. The following example relates to the simple basic pattern 23, but it is easy to transpose it to any pattern constituted by several superimposed patterns. If the coordinates of the treated pixel, relatively to the block of the image which contains this pixel, are, for example X=3 and Y=1(X and Y ranging from 0 to 3) and if the pattern 23 of FIG. 2 is selected, the dot of this selected pattern having the same position as the pixel in its block, i.e. X=3 and Y=1, will be the dot marked x, which is white, and the pixel will thus be displayed as an inactive pixel. With the same selected pattern 23, but with pixel coordinates of, for example X=1 and Y=1, relatively to the block of the image which contains this pixel, the dot having the same position as the pixel in its block is the second from the top left, which dot is black, and the pixel will thus be displayed as an active pixel.

As there is a maximum number of 16 different patterns in the set of FIG. 1, the count up of redefinitions for the selection of a pattern of FIG. 1 is effected modulo-16, and similarly it is effected modulo-8 for the set of patterns of FIG. 2, modulo-4 for the set of patterns of FIG. 3 and modulo-2 for the set of patterns of FIG. 3. The patterns of numbers 0+20+30+40, then 1+21+31+41, then 2+22+32+40, then 3+23+33+41, then 4+24+30+40 and so forth are thus successively selected in the course of time until 14+26+32+40 and finally 15+27+33+41 are reached before returning to 0+20+30+40.

The patterns have such a composition that, at each redefinition, a set of several basic patterns corresponding to different grey levels, i.e. taken in different figures, has no active pixels at the same positions as in another pattern. It can be verified that this condition is fulfilled for each one of the possible selections.

Many other sets of the type similar to those shown in FIGS. 2 to 4 can of course be conceived. For example, there are 120 different ways of drawing a pattern of the type shown in FIG. 2, 1680 different ways of drawing a pattern of the type shown in FIG. 3 and 12870 different ways of drawing a pattern of the type shown in FIG. 4. The number of useful combinations is, however, limited by the condition that in two sets corresponding to two different grey levels a selected pattern of a set should not have active pixels at the same places as a selected pattern of another set, but nevertheless a large number of possible combinations remains.

Figure 5:
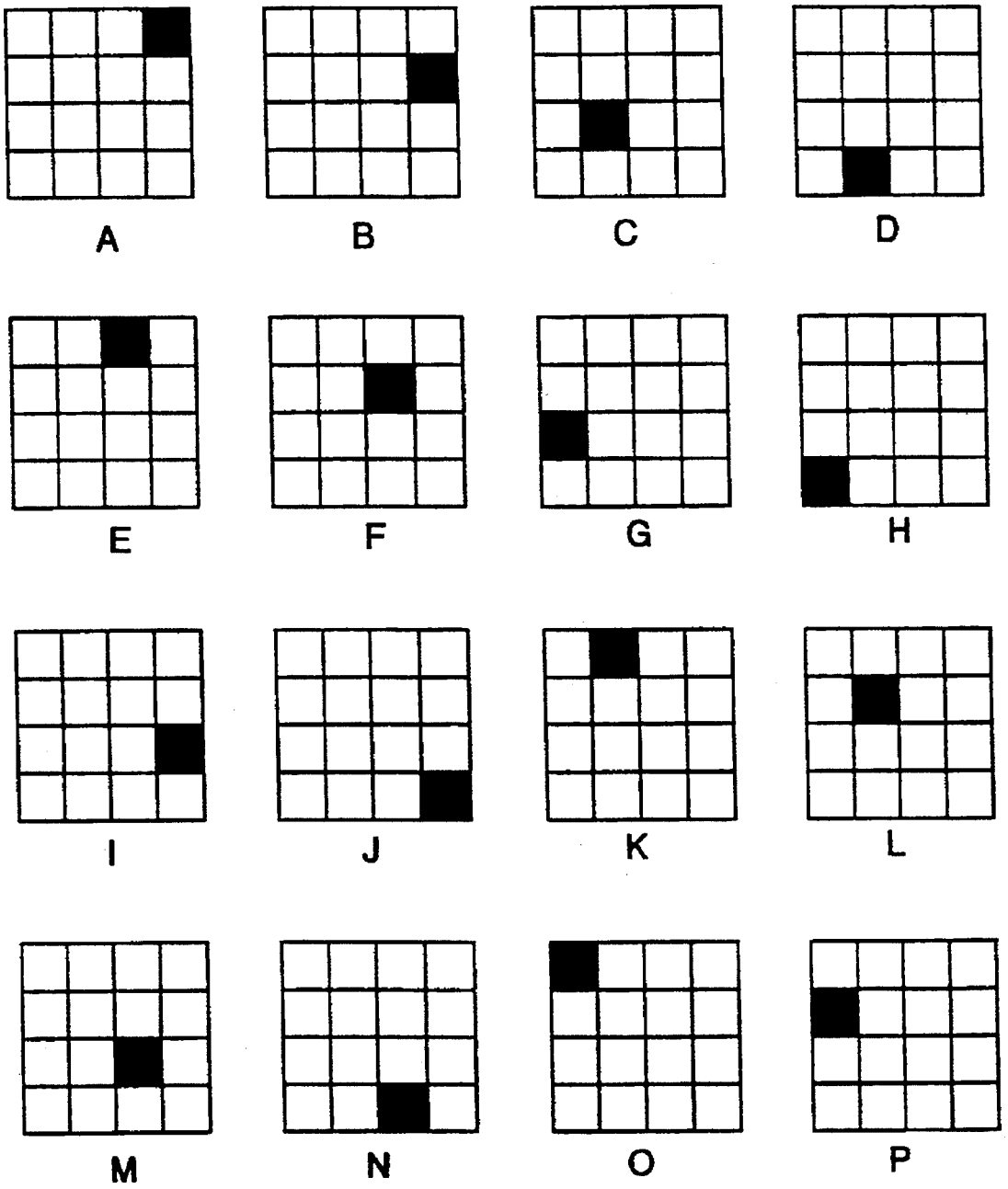
FIG. 5 shows an example of developing the position of a pattern in a matrix during sixteen successive fields numbered A to P.

To select a different pattern for each of the neighbouring blocks, when a zone of the same grey level covers several neighbouring blocks of pixels in the image in a regular manner, a set of matrices of patterns each comprising several neighbouring patterns in the two horizontal and vertical directions is defined in advance for each grey level, the different patterns of the same matrix all having a different arrangement of dots representing inactive pixels and dots representing active pixels. A matrix comprises, for example sixteen (4×4) patterns in this case. For each number of active dots (one, two, four, eight) in the basic pattern, an assembly of sixteen mutually different basic matrices is thus defined, each comprising sixteen basic patterns with the number of active dots required. A matrix of the set of matrices corresponding to the grey level in question is selected at each redefinition, while another matrix of the same set is selected at the subsequent redefinition, and so forth. FIG. 5 shows sixteen matrices. From matrix to matrix, the position of a given pattern develops in the matrix. In spite of its similarity with FIGS. 1 to 3, this Figure is different and each of its tiles represents a pattern of 4×4 pixels. The black square represents a given basic pattern. At the time A, said given basic pattern is situated, for example at the top right of the matrix, at the next time (B) it descends one position, at the subsequent time (C) it descends one position to the bottom and two positions to the left, and so forth (D, E, F, etc.). At a given moment, for example, at the time A and for a basic matrix corresponding to a grey level of 1/16, with the patterns thus being taken from FIG. 1, the top line of the matrix A comprises, for example the patterns 7+13+10+0, the line 2 comprises the patterns 2+8+15+5, the line 3 comprises the patterns 1+11+12+6, and the line 4 comprises the patterns 4+14+9+3. The contents at the other moments can be deduced by means of displacements as indicated above. It has been observed that this manner of defining the matrices leads to a particularly favourable visual perception. Other ways of defining can certainly also yield favourable results but in any case certain definitions of matrices and certain ways of displacing the patterns yield better results than others.

Of course, also in this case a matrix corresponding to an intermediate grey level is constructed by superimposing the appropriate basic matrix. The screen is virtually divided into squares of 4×4 blocks, and at each redefinition a pixel is displayed with the active or inactive state of the dot having the same position in the selected matrix as the pixel in its square of 4×4 blocks. In fact it is equivalent to working with a simple pattern which would have 16×16 pixels. Nevertheless, the organization of the hardware based on such a method has an advantageous freelike structure.

Figure 6:
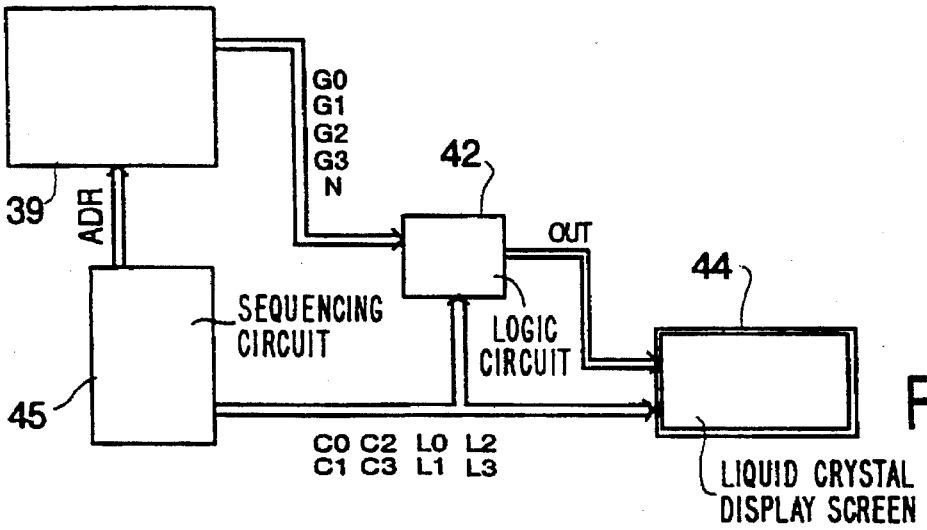
FIG. 6 is a diagram of a complete device.

A device for generating the appearance of grey levels in a passive matrix liquid crystal display screen is shown in FIG. 6. It comprises:

- a memory 39 in which the data G0, G1, G2, G3, N defining a grey level for each pixel are stored,
- a wired logic circuit 42 which computes, in accordance with the inventive method, the state of a pixel as a function of its position in a matrix and as a function of the bits of data G0–G3 and N defining the desired tint for this pixel. A matrix comprising four patterns of 4×4 has 16×16 dots and a position is defined by four bits of the row L0–L3 and four bits of the column C0–C3. In practice this circuit 42 comprises four circuits in parallel (not shown) for working on four pixels at a time. A dock (not shown) has a cycle time of approximately 0.7 μs, and the circuit 42 thus supplies every 0.7 μs the state to be displayed for four pixels, which thus requires approximately 0.18 μs per pixel. A screen comprises, for example 320×240 pixels. The complete redefinition of a screen could thus be realised every 0.18 μs ×320×240=0.014 s, i.e. at a frequency of approximately 70 Hz, a passive matrix liquid crystal display screen 44, a sequencing circuit 45 which selects the pixels of an image in turns and supplies the related address ADR each time to the memory 39, and the coordinates C0–C3, L0–L3 of the pixel in the image to the processor 42 and the screen 44. The output of the processor 42 is directly connected to the screen for supplying it with the OUT state of the current pixel which it can memorize because of the capacitive effect mentioned above.

The coordinates of a pixel are defined by four bits of the column C0–C3 and four bits of the row L1–L3. The bits L0–L1 and the bits C0–C1 define the position of the pixel in a block, the bits L2–L3 and the bits C2–C3 define the position of the block in a matrix. The coordinate input terminals are denoted by these references. One of the four circuits constituting the circuit 42 of FIG. 6 is shown in greater detail in FIG. 7. It comprises:

a circuit 38 for defining the state of the pixel, which will be described with reference to FIG. 8, in series with the path of the coordinate bits C0, C1, L0, L1, a mixer circuit 35 constituted by logic elements modifying the coordinate bits, which will be described with reference to FIG. 9, in series with the path of coordinate bits C2, C3, L2, L3, a mixer circuit 36 which is identical to the circuit 35, also in series in the path of coordinate bits, following the mixer circuit 36, an adder circuit 37 having two groups of four inputs and four outputs. The group of four inputs B0–B3 is connected to four outputs P0–P3 of the mixer circuit 36, while four conductors T0–T3 each of which receives a bit of a multiplet indicating a number of the image (modulo 16) are connected to the other group of four inputs A0–A3, and the four outputs S0–S3 of the adder are connected to terminals S0–S3 of the logic circuit 38. The adder in question is a commercially available model.

Figure 7:
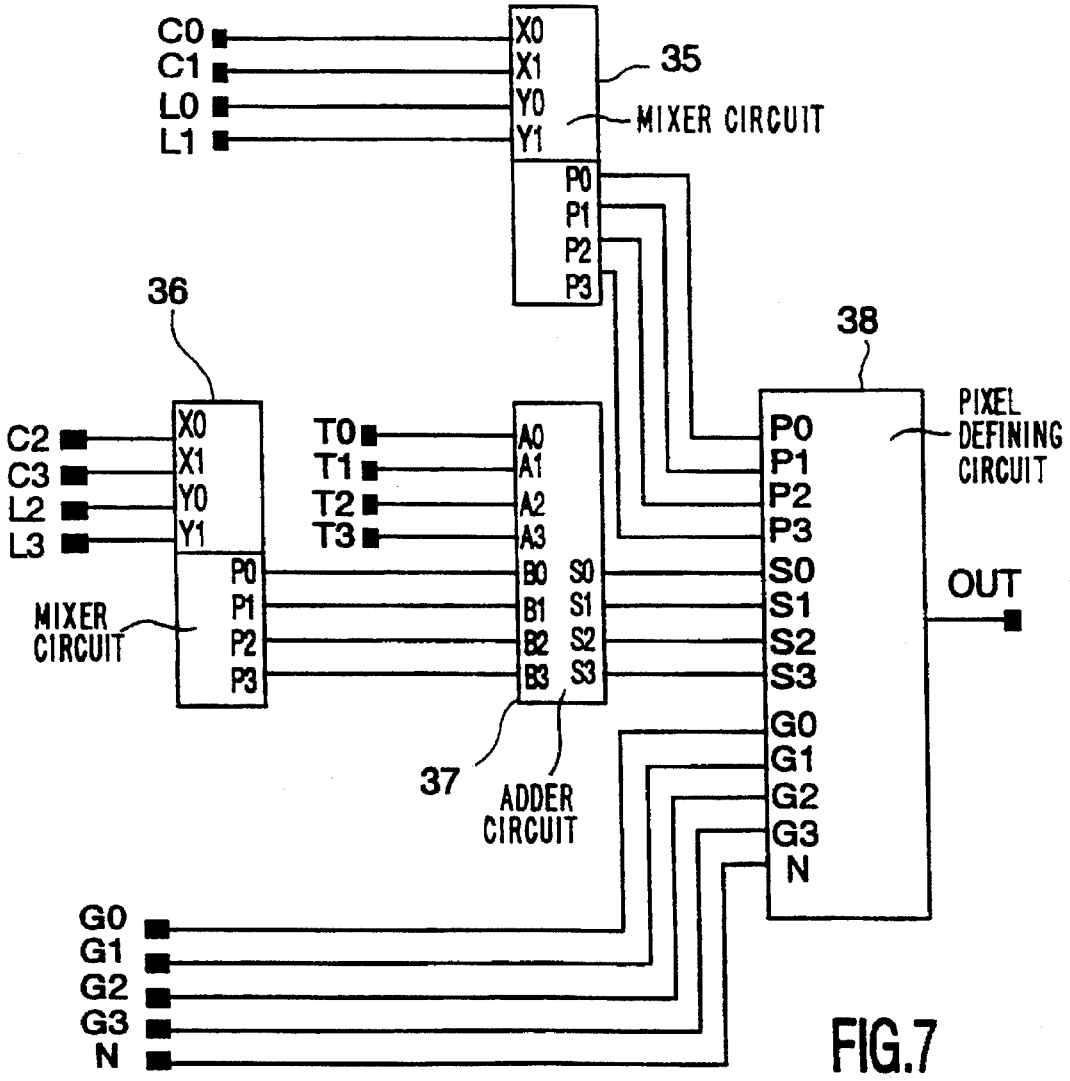
FIG. 7 is a diagram of a part of the device with a wired logic circuit, two mixer sub-circuits and an adder.
Figure 8:
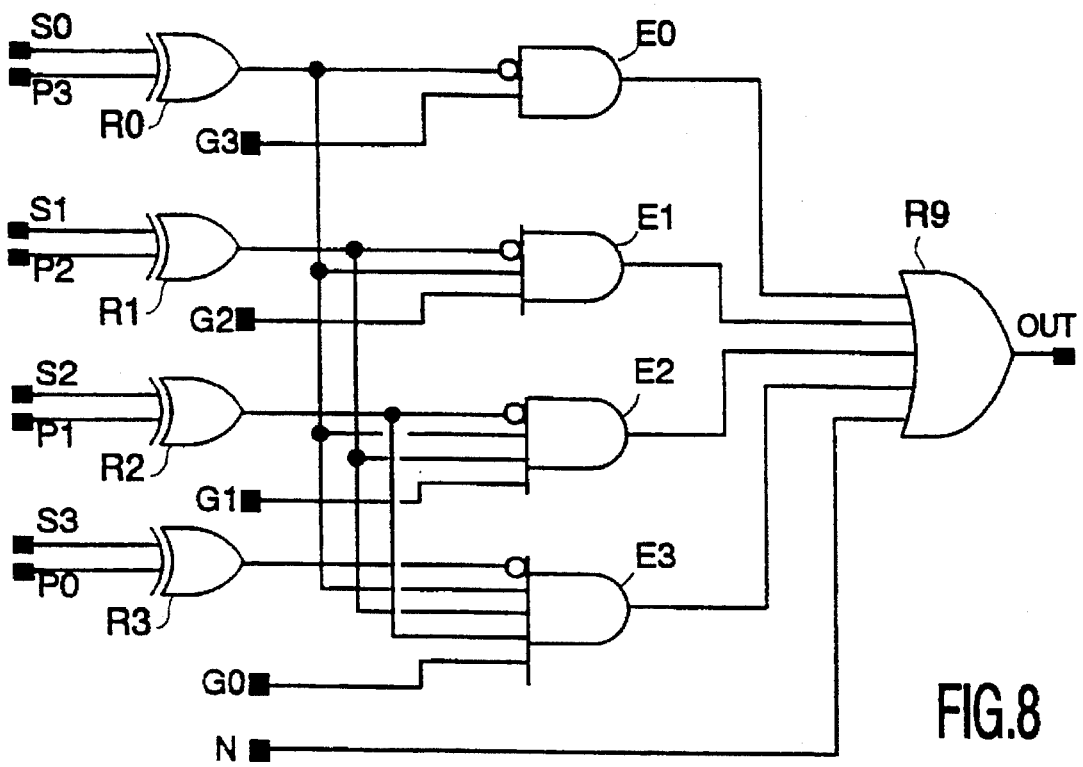
FIG. 8 is a diagram of a wired logic circuit according to the invention.

The circuit 38 of FIG. 7 is shown in greater detail in FIG. 8. It has four input terminals for coordinates S0, S1, $2, $3 each for receiving a coordinate bit modified by the mixer circuit 36 and the adder 37, four input terminals for coordinates P0, P1, P2, P3 each for receiving a coordinate bit modified by the mixer circuit 35, four "grey" input terminals G0, G1, G2, G3 each for receiving one of the grey bits and one "black" input N for a bit possibly indicating that the pixel is 100% black. It is constituted by four exclusive-OR gates R0, R1, R2, R3, each with two inputs, four AND gates E0, E1, E2, E3, each with at least two inputs (two for the gate E0, three for the gate E1, four for the gate E2, five for the gate E3), and an output OR gate R9 having five inputs. The inputs of the exclusive-OR gate R0 are connected to the input terminals for the coordinates SO and P3, the inputs of the exclusive-OR gate R1 are connected to the input terminals for the coordinates S1 and P2, the inputs of the exclusive-OR gate R2 are connected to the input terminals for the coordinates S2 and P1, the inputs of the exclusive-OR gate R3 are connected to the input terminals for the coordinates S3 and P0. The output of the number zero exclusive-OR gate (R0) is connected in an inverted manner to an input of the number zero AND gate (E0) and in a non-inverted manner to each of the AND gates of the higher number E1, E2, E3. The output of the exclusive-OR gate number R1 is connected in an inverted manner to an input of the AND gate of number El, and in a non-inverted manner to each of the AND gates of the higher number E2, E3. The output of the exclusive-OR gate number R2 is connected in an inverted manner to an input of the AND gate of number E2 and in a non-inverted manner to the AND gate of the higher number E3. The output of the exclusive-OR gate number R3 is connected in an inverted manner to an input of the AND gate of number E3. Each of the outputs of the AND gates is connected to an input of the output OR gate R9 which provides the state to be given to the pixel at its output "OUT". Each grey input G0, G1, G2, G3 is connected to an input of the AND gate of numbers E3, E2, E1, E0, respectively, and the black input N is connected to an input of the output OR gate (R9).

It is evident that the circuit could easily be adapted if the dimension chosen for the blocks of pixels were different, and that a different circuit capable of supplying the same logic equations could easily be conceived by those skilled in the art.

Figure 9:
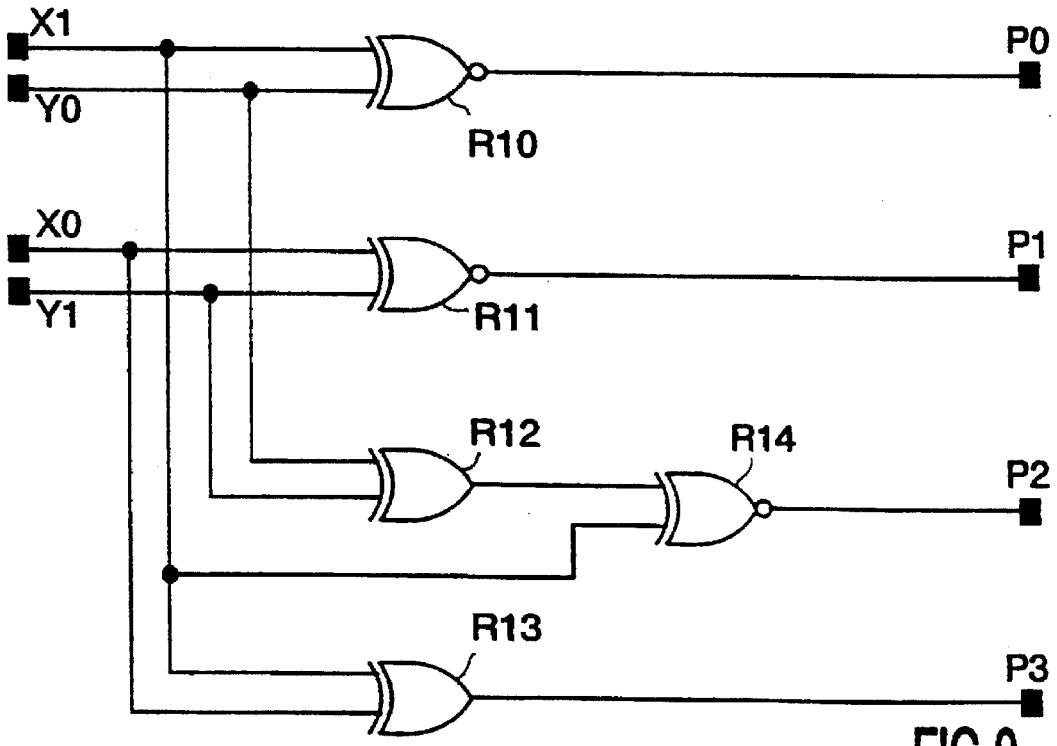
FIG. 9 is a circuit diagram of a mixer circuit according to the invention.

One of the two circuits 35 or 36 of FIG. 7 is shown in greater detail in FIG. 9. It comprises three exclusive-NOR gates R10, R11, R14 having two inputs and two exclusive-OR gates R12, R13 having two inputs. The two inputs of the gate R11 are connected to terminals X0, Y1. The two inputs of the gate R12 are connected to terminals Y0, Y1. The two inputs of the gate R13 are connected to terminals X1, X0. One input of the gate R14 is connected to the output of the gate R12 and the other is connected to the terminal X1. The outputs of the gates R10, R11, R14, R13 are connected to terminals P0, P1, P2, P3, respectively. These logic elements represent the following Boolean equations:

$$P0=X1\oplus Y0$$

$$P1=X0\oplus Y1$$

$$P2=X1\oplus Y0\oplus Y1$$

$$P3=X1\oplus X0$$

In practice, the input or data in a liquid crystal display screen is generally realised with groups of four or eight bits in parallel. Consequently, in the wired logic circuit 42 of FIG. 6 there are advantageously four (or eight) devices which are identical to those of FIG. 7. The buses (G0, G1, etc. and C0, C1, etc. ) then convey the data concerning four pixels in parallel and the output OUT is realised by a bus having four conductors.

We claim:

1. A method of generating a visual appearance of different grey levels in a liquid crystal display screen having a passive matrix of pixels having only an active or an inactive state for each pixel, a surface having an apparent grey level being obtained by activating a given proportion of pixels, and the screen being virtually divided into blocks of pixels all having the same dimension, wherein patterns of active or inactive dots are defined in advance, each dot corresponding to a pixel, each pattern representing a block and corresponding to one of the grey levels due to the face that it has a number of active dots corresponding to this grey level, the active or inactive state of a pixel contained in a block of the image being displayed corresponding to the active or the inactive state of the dot which, in a pattern corresponding to the grey level desired for said pixel, has the same position as the pixel in the block comprising this pixel, a set comprising a limited number of basic pattern is defined in advance, each pattern of a set comprising a number of active pixels per pattern equal to a power of two (one, two, four, eight), while the basic patterns have such a composition that each position of an active pixel is exclusively utilized in a single one of the basic patterns of the set, and a pattern for generating a grey level not provided in a single pattern of the set of patterns is constructed by superimposing several patterns of this set.

2. A method as claimed in claim 1, in which the patterns are redefined periodically, characterized in that an assembly of several sets of different basic patterns (0+20+30+40+, 1+21+31+41+, 2+22+32+40+, 3+23+33+41+, 4+24+30+40+, etc.) is defined in advance, each of the sets complying with the rule that each position of an active pixel is exclusively utilized in a single one of the basic patterns of the same set, and the periodical redefinition of the patterns is realised by cyclically selecting all the sets of this assembly in turns.

3. A method as claimed in claim 2, characterized in that, when the same grey level is desired for two pixels, one of which being situated in a block and the other in a neighbouring block, a set of patterns is selected in different assemblies for each of these two pixels.

4. A device for generating the appearance of grey levels in a liquid crystal display screen having a passive matrix of pixels having only an active or an inactive state for each pixel, comprising a wired logic circuit (42) which computes the state in which a pixel is to be displayed as a function of its position in a block and a s function of the grey level desired for this pixel, characterized in that, with "n" being an integral number, said wired logic circuit comprises a circuit (38) for defining the state of the pixel which is provided with tow sets of n coordinate input terminals (P0–P3+S0–S3) each for receiving a bit of coordinate of a pixel and n "grey " input terminals (G0–G3) each for receiving a grey bit and a "black" input (N) for a bit possibly indicating whether the pixel is 100% black, and is constituted by n exclusive—OR gates (R0–R3) each having two inputs, n AND gates (E0–E3) each having at least two inputs and an OR output gate (R9) having n+1 inputs, and each of the two inputs of each exclusive—OR gate is connected to one of the coordinate input terminals (S0, P3, S1, P2, S2, P1, S3, P0) and, by attributing a number to each of the OR gates and to each of the AND gates, the output of an exclusive—OR gate of a given number is connected to an input of the AND gate of the same number of the AND gates of the higher number, if any, each of the outputs of the AND gates (E0–E3) is connected to an input of the output OR gate (R9) whose output (OUT) supplies the state to be given to the pixel, and each grey input (G0–G3) is connected to an input of one of the AND gates and the black input (N) is connected to an input of the output OR gate (R9).

5. A device as claimed in claim 4, characterized in that it comprises, in series in the path of certain coordinate bits, an adder circuit (37) having two groups of n inputs and n outputs, one of the groups of n inputs (B0–B3) being connected to n input terminals for the coordinates (C2,C3, L2,L3) while n conductors (T0–T3) each conveying a bit indicating a numbering of the image are connected to the other group of n inputs (A0–A3), the n outputs of the adder (37) being connected to one of the sets of coordinate inputs of the circuit (38) for defining the state of the pixel.

6. A device as claimed in claim 4, characterized in that it comprises, in series in the path of coordinate bits, a mixer circuit (35+36) constituted by logic elements modifying the coordinate bits.

7. A device as claimed in claim 6, characterized in that, with the number of coordinate bits being even, the mixer circuit is constituted by two mixer sub-circuits (35,36) each having n input terminals (X1,Y0,X0,Y1) for the coordinates, and n outputs (P0–P3), while the bits of the smallest weight (C0,C1,L0,L1) of each coordinate are applied to one of the sub-circuits (35) and the bits of the largest weight (C2,C3, L2,L3) are applied to the other sub-circuit (36).

8. A device as claimed in claim 7, characterized in that, with n being equal to four, each mixer sub-circuit is constituted by logic elements (R10–R14) representing the following Boolean equations, the four inputs being denoted X0, X1 for the coordinates plotted on the abscissa, Y0, Y1 for the coordinates plotted on the ordinate and the outputs being denoted P0–P3:

$$P0=X1\oplus Y0$$

$$P1=X0\oplus Y1$$

$$P2=X1\oplus Y0\oplus Y1$$

$$P3=X1\oplus X0.$$

9. A device as claimed in claim 5, characterized in that it comprises, in series in the path of coordinate bits, a mixer circuit (35+36) constituted by logic elements modifying the coordinate bits.

* * * * *